United States Patent [19]

Doi et al.

[11] 4,268,163

[45] May 19, 1981

[54] PAPER FEEDING DEVICE FOR A COPYING MACHINE

[75] Inventors: Yasuhiko Doi; Soichi Iwao; Takaharu Takagishi, all of Toyokawa, Japan

[73] Assignee: Minolta Camera Kabushiki Kaisha, Osaka, Japan

[21] Appl. No.: 54,915

[22] Filed: Jul. 5, 1979

[30] Foreign Application Priority Data

Jul. 7, 1978 [JP] Japan ..... 53-94300[U]

[51] Int. Cl.[3] ..... G03G 15/00

[52] U.S. Cl. ..... 355/14 SH; 271/274; 355/3 SH

[58] Field of Search ..... 355/14 SH, 3 SH, 14 R, 355/16; 271/273, 274; 226/181, 186, 191

[56] References Cited

U.S. PATENT DOCUMENTS 3,324,791 6/1967 Cassano et al. ..... 271/274 X 4,155,545 5/1979 Yanagawa et al. ..... 271/274 X

OTHER PUBLICATIONS

*IBM Tech. Disc. Bull.,* "Fuser Drive Mechanism", vol. 19, No. 5, Oct. 1976, p. 1597.

*Primary Examiner*—Richard L. Moses

*Attorney, Agent, or Firm*—Watson, Cole, Grindle & Watson

[57] ABSTRACT

An electrostatic copying apparatus has a device for nipping a leading end of a strip of paper as paid off from a roll and for feeding the paper during the copying operation. A driving motor is provided for operating the apparatus, and the device includes a pair of feed rollers movable out of contact with one another, and a mechanism is provided for effecting such movement. A mechanism is also provided for actuating the moving mechanism, and the feed rollers, the driving motor and the actuating mechanism are so controlled as to maintain the rollers in contact with one another during the copying operation. The actuating mechanism is arranged for effecting movement of the rollers out of contact with one another during inoperation of the driving motor.

10 Claims, 6 Drawing Figures

PAPER FEEDING DEVICE FOR A COPYING MACHINE

BACKGROUND OF THE INVENTION

1. Field of the Invention

The present invention relates to a device for feeding paper for use in electrophotographic copying machines and the like, and more particularly to a device by which a strip of copying paper stocked in the form of a roll is fed into such a machine.

2. Description of the Prior Art

With copying machines which use a strip of copying paper wound up into a roll, the leading end of the paper is nipped by a pair of feed rollers, which are driven with the operation of the machine to feed the paper into the machine by a suitable length, whereupon the paper is cut by a cutter and the feed rollers are halted.

The pair of feed rollers are held in pressing contact with each other as by a spring, such that even while out of operation, the rollers retain the leading end of the copying paper in nipping engagement therewith for a subsequent copying operation.

On the other hand, while the copying machine is in operation as when making a large number of copies in succession, the interior temperature of the machine rises to about 10° C. to about 15° C. with an attendant reduction in the interior humidity. Further while the machine is out of operation, the humidity varies owing to a marked reduction in the temperature during the nighttime, consequently subjecting the roll of copying paper within the machine to noticeable humidity variations irrespective of whether or not the machine is operated.

If the copying paper is subjected to such variations in temperature, humidity and like ambient conditions with its leading end nipped between the feed rollers, the paper will expand or contract, for example, owing to variations in the water content of the paper, whereas the nipped portion alone will be prevented from expansion or contraction. This produces wrinkles in the paper.

SUMMARY OF THE INVENTION

The main object of this invention is to provide a device for feeding to a mechanical apparatus a strip of paper as paid off from a roll, the device comprising a pair of feed rollers for nipping the leading end of the paper which are adapted to move out of contact with each other at least while the main motor of the apparatus is not operating so that the paper will not wrinkle at the nip of the rollers even when subjected to variations in temperature or humidity while the apparatus is out of operation.

Another object of the invention is to provide a paper feeding device of the type described above which includes means for holding the leading end of the paper over a small area while the feed rollers are out of contact with one another to thereby retain the leading end in position without impairing the above-mentioned effect of preventing the paper from wrinkling.

DESCRIPTION OF THE PREFERRED EMBODIMENT

The construction and operation of the electrophotographic copying machine 100 shown in FIG. 1 will be described first, the drive means according to the invention being shown in phantom outline therein.

Figure 1:
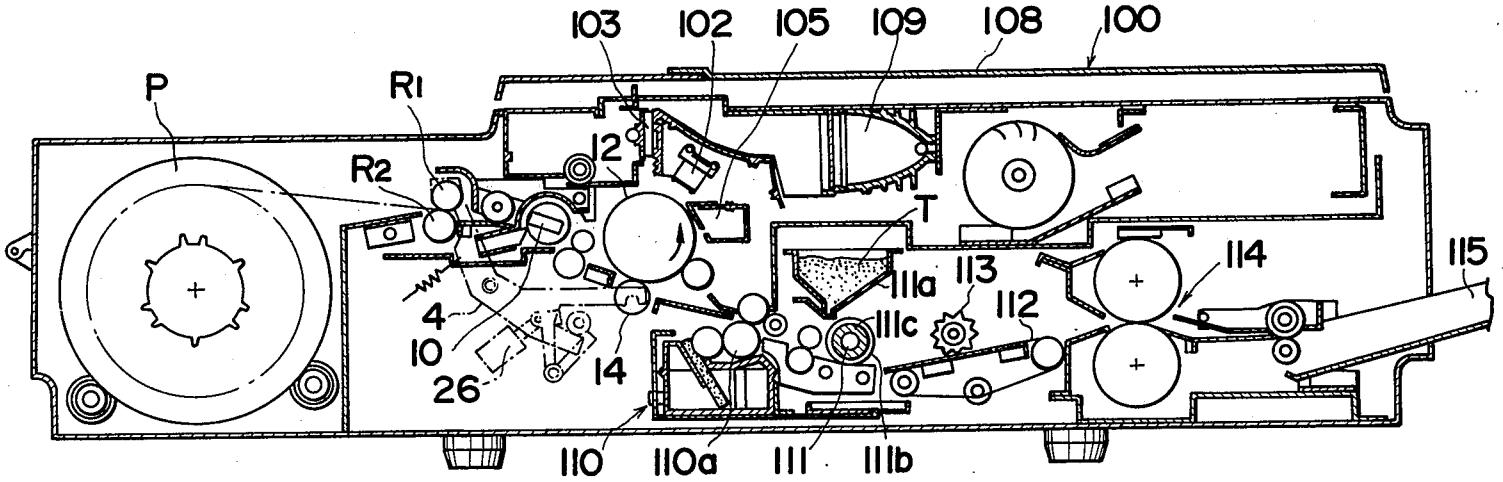
FIG. 1 is a view in section of a copying machine incorporating a paper feeding device of the invention.

The machine includes a photoconductive drum 12 which is rotatable in a counterclockwise direction in FIG. 1 and is surrounded by a charger 102, an exposure lens unit 103, a roller 14 for transferring latent images, a charge removing eraser 105, etc., as arranged in the order mentioned.

A roll of copying paper P has a leading end nipped between a pair of feed rollers R1 and R2, which when rotated by a suitable drive means in response to a drive signal, pass the paper P forward. The paper is cut to a suitable length by a cutter 10. The latent electrostatic images formed on the photoconductive drum 12 are transferred by the transfer roller 14 onto the cut-off sheet of paper.

The method of forming latent electrostatic images on the photoconductive drum 12 is already well known and will not be described in detail. Briefly stated, latent images are formed by uniformly charging the surface of the drum 12 by the charger 102 while the drum is in rotation and causing an exposure lamp 109 to illuminate an original (not shown) on a carriage 108 driven leftward in FIG. 1 in timed relation to the photoconductive drum 12 while exposing the drum 12 to the reflected light through the lens unit 103. The copying paper P is composed essentially of a conductive layer and an insulating layer. The insulating layer is brought into proximity to or pressing contact with the surface of the photoconductive drum 12 for the transfer of the latent images thereto.

The copying paper P bearing the transferred latent images thereon is separated from the photoconductive surface, passed through a water-adding unit 110 and then through a developing unit 111 in which the latent images are converted to visible images with a toner. The paper is thereafter sent into a pressure fixing apparatus 114 by a conveyor belt 112, a retaining wheel 113, etc. The paper bearing the fixed images thereon is sent out onto a tray 115 on completion of the copying operation.

The water-adding unit 110 used for maintaining the rear conductive layer of the copying paper P at an increased and constant conductivity includes a roller **110*a*** to which water is always applied at a substantially constant rate.

In the developing unit 111, a magnetic developer T contained in a toner tank **111*a* is applied to a sleeve 111*b* and retained thereon by a magnet 111*c*. The toner is deposited on the latent electrostatic images on the copying paper P transported by the rotation of the magnet 111*c* and/or the sleeve 111*b***.

An embodiment of the invention will now be described with reference to FIG. 2 et seq.

Figure 2:
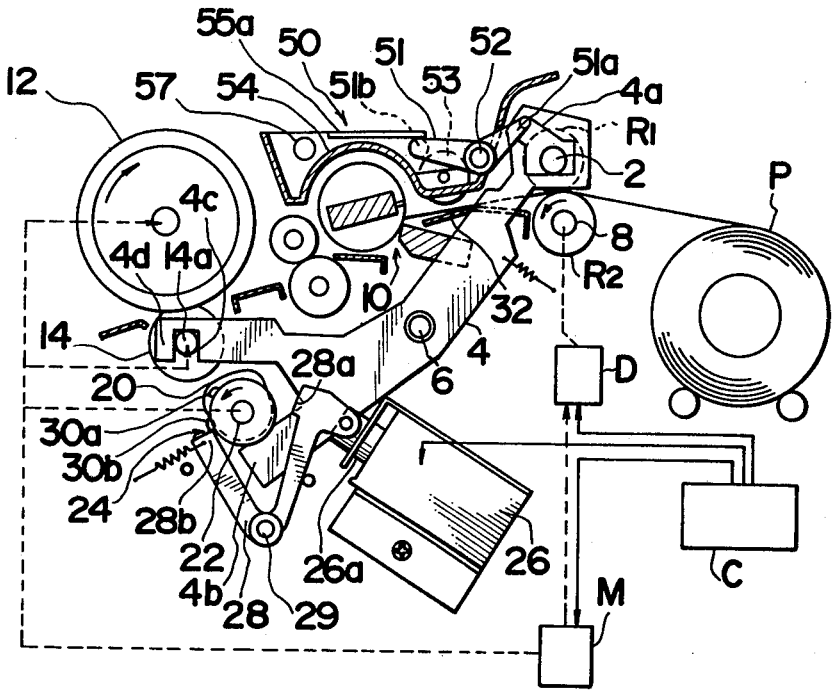
FIG. 2 is a view showing the paper feeding device of the invention.

In FIG. 2, the roll of copying paper P is mounted for rotation in any normal manner with the leading end of the paper nipped between the pair of upper and lower feed rollers R1 and R2.

The upper feed roller R1 has a shaft 2 supported for vertical movement along slotted portions of a frame of the copying machine main body (not shown). The shaft 2 is mounted on a roller raising portion 4*a* of each of a pair of levers 4 (only one shown) by which the feed rollers may be moved into or out of contact with one another. As wll be more clearly seen hereinafter, the lever 4, pivotally mounted on a pivot pin 6, is caused to pivot counterclockwise from its FIG. 2 to its FIG. 4 position to thereby raise the shaft 2 of the upper roller R1. The lower feed roller R2 has a shaft 8 rotatably mounted on the machine in any normal manner.

A spring or the like means (not shown) biases the shafts 2 and 8 of the feed rollers R1 and R2 toward each other, holding the rollers in pressing contact with each other as seen in FIG. 2. The shaft 8 of the lower roller R2 is rotated counterclockwise when viewed in FIG. 2 by a suitable drive means D, whereby the copying paper P is passed through the cutter 10 leftward in the drawing and then between the photoconductive drum 12 and the transfer roller 14. The latent electrostatic images formed on the drum 12 are transferred onto the paper P as described above, while the cutter 10 operates in response to a suitable signal to cut the paper P, and the feed roller R2 is brought to a halt. Accordingly the cut portion of the copying paper P formed by the cutter 10 is stopped and provides a new leading end as nipped between the feed rollers R1 and R2.

The lever 4 pivotally supported on pivot 6 has one end formed with the aforementioned roller raising portions 4*a* and the other end bifurcated into a cam contact portion 4*b* for contact with an aligned cam member 20 and a transfer roller depressing portion 4*d* which is provided with a cutout 4*c* for engagement with the shaft 14*a* of the transfer roller 14. The transfer roller is spring biased (not shown) for pressing contact with drum 12 and shaft 14*a* is mounted on the machine in any normal manner so that it may be moved toward and away from drum 12.

Figure 3:
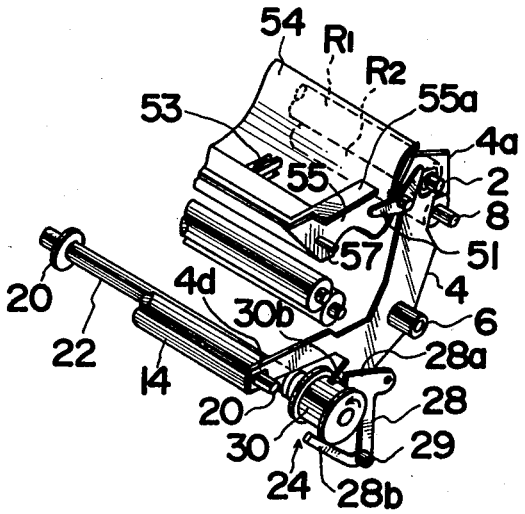
FIG. 3 is a fragmentary perspective view of the device.
Figure 4:
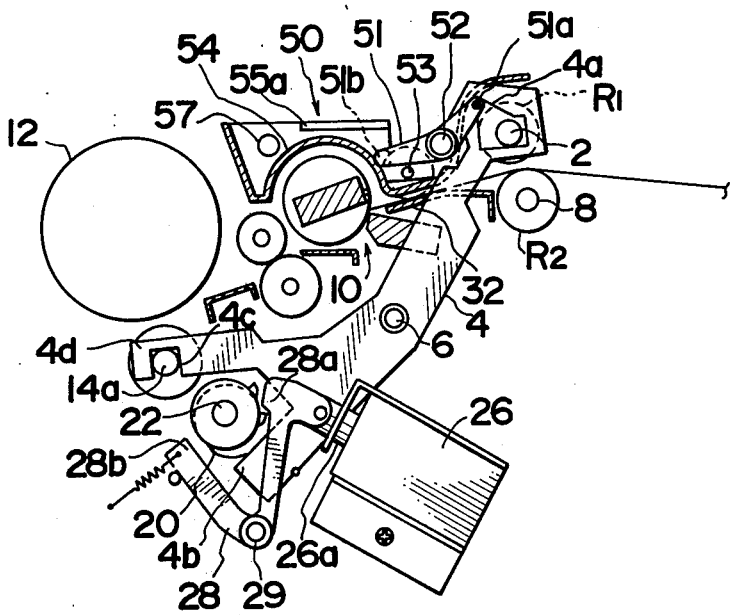
FIG. 4 is a view showing the device with its paper feed rollers held away from each other.
Figure 5:
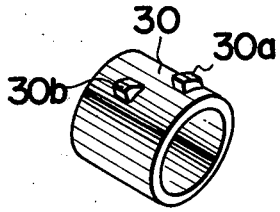
FIG. 5 is a perspective view showing a clutch drum.

As shown in FIGS. 2 to 4, a cam member 20 is associated with each lever 4 and is mounted on a drive shaft 22 for relative rotation. Drive shaft 22 is operatively connected to a drive motor M for rotation in the direction of the arrow of FIG. 2, and each cam 20 is coupled with a clutch means 24 for transmitting rotation of shaft 22 to the cam. A solenoid 26 which is energized in operative relation with the operation of the copying machine has a plunger 26*a* connected to a V-shaped engaging lever or arm 28 provided with engaging portions 28*a* and 28*b*, and pivotally mounted on the machine as at 29. The clutch means 24 is so adapted that the engaging portions 28*a* and 28*b* are in alignment with projections 30*a* and 30*b* located on a clutch drum 30 (see FIG. 5), so that when portions 28*a* and 28*b* are in engagement with these projections, the rotation of the drive shaft 22 is not transmitted to the cam member 20, while permitting the rotation of the cam member 20 together with shaft 22 when the engaging portions are out of engagment with the projections. Stated more specifically the clutch means 24 incorporates a standard spring clutch mechanism in which a coil spring (not shown) provided between the clutch drum 30 and the drive shaft 22 is adapted to exert no fastening force while the engaging portions 28*a* and 28*b* are in engagement with the projections.

FIG. 2 shows the feed rollers R1 and R2 in pressing contact with each other. In this condition, the solenoid 26 is maintained energized with the engaging portion 28*b* of the engaging lever 28 in engagment with the projection 30*b* of the clutch drum 30, while the portion of the eccentric cam member 20 having the smallest radius is in contact with the cam contact portion 4*b* of the lever 4, and shaft 22 is permitted to freely rotate relative to the cam. The lever 4 is biased by a spring or like means for clockwise rotation about the pivot 6, whereby the roller raising portion 4*a* is retained in a lowered position in which the portion 4*a* exerts no lifting force on the upper roller R1. The feed rollers R1 and R2 are held in pressing contact with each other as by a spring. The transfer roller depressing portion 4*d* of the lever 4 is in a slightly raised position in which the portion 4*d* exerts no depressing action on the shaft 14*a* of the transfer roller 14. A spring or like suitable means retains the transfer roller 14 in pressing contact with the photoconductive drum 12.

An actuating lever 51 of a paper holding assembly 50 is pivotally connected with the roller raising portion 4*a* of the lever 4 by means of a pin 51*a*. The roller raising portion 4*a*, when moved to the lowered position of FIG. 2, causes the lever 51 to pivot clockwise in FIG. 2 about a pivot pin 52 so as to cause a pin 51*b* fixed to the other end of the lever 51 to thereby lift a paper holding roller 53.

Figure 6:
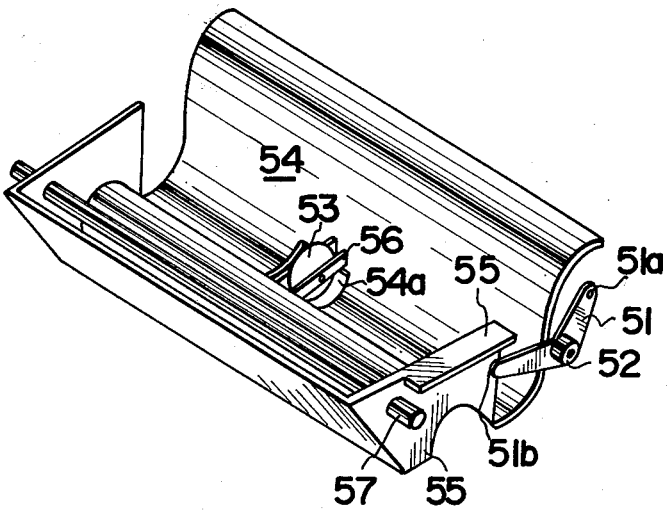
FIG. 6 is a fragmentary perspective view of an assembly for holding the leading end of rolled-up paper.

The paper holding assembly 50 comprises a plate 54 mounted for pivotal movement on the machine about a shaft 57, plate 54 service also as a guide for transporting the copying paper P, and the paper holding roller 53 being mounted for rotation on the plate 54 and projecting slightly downwardly therefrom. The pin 51*b* on the lever 51 is in contact with a bent portion 55*a* of a side plate 55 of plate 54 (see FIG. 6) for thereby lifting plate 54 upon clockwise pivotal movement of lever 51. The paper holding roller 53 is rotatably mounted on support members 56, with its lower end projecting through a slot 54*a* located in the pivotal plate 54 so as to contact a transport guide 32 on the lower side of the paper P to be fed. The Holding roller 53 lowers with the clockwise movement of the pivotal plate 54 about pivot 57 to hold a leading end portion of the copying paper P between the roller 53 and the guide 32.

The plate 54 pivots clockwise in FIG. 2 under gravity while pushing down the pin 51*b* on the lever 51, when the lever 4 is turned counterclockwise by the operation to be described later to lift the roller raising portion 4*a* so as to raise the feed roller R1.

On completion of a copying cycle after the drive unit D for the feed roller R2 has been stopped in response to a signal from a control C of the copying machine while in the condition of FIG. 2, the solenoid 26 is de-energized, turning the lever 28 on pivot 29 counterclockwise so as to disengage the engaging portion 28*b* from the projection 30*b*, whereupon the rotation of the drive shaft 22 is transmitted to the cam member 20. The cam member 20 rotates to push the cam contact portion 4*b* of the lever 4 downward. With the rotation of the clutch drum 30, the projection 30*a* comes into contact with the engaging portion 28*a* of the lever 28, which in turn holds the clutch drum 30 against rotation again to stop the cam member 20. The parts are now in the position shown in FIGS. 3 and 4, in which the cam member 20 bears against the cam contact portion 4*b* at its major radius portion. Consequently the lever 4 in the condition of FIG. 2 turns counterclockwise, lifting the roller raising portion 4*a* to raise the shaft 2 of the feed roller R1 and move the roller R1 away from the roller R2. At the same time, the transfer roller 14 is brought out of contact with the photoconductive drum 12 with its shaft 14*a* pushed down by the depressing portion 4*d* of the lever 4, while the lift of the roller raising portion 4*a* of the lever 4 lowers the pivotal plate 54 to cause the paper holding roller 53 to hold a leading end portion of the copying paper between the roller and the guide 32.

The foregoing operation follows the completion of each copying cycle. The transfer roller 14 is adapted to come into and out of contact with the photoconductive drum 12 in operative relation with the copying cycle to avoid the deformation or like fault of the roller 14 that would occur if the soft transfer roller is held pressed against the drum 12 while the copying machine is out of operation. The roller 53 for holding the leading end of the copying paper P avoids the drawback wherein the tension exerted by the rolled-up portion of the paper would retract the leading end of the paper while the feed rollers R1 and R2 are away from each other without retaining the paper in position. The paper holding roller 53 is relatively thin so as to contact the paper over a reduced area to avoid wrinkling.

The solenoid 26 is energized and de-energized with suitable timing in operative relation with the copying cycle. For example, with a copying machine in which the main motor is adapted to rotate on closing the print switch, the solenoid is energized with the start of the motor, causing the engaging portion 28*b* of the lever 28 to engage the projection 30*b* of the clutch drum 30 to bring the feed roller R1 into pressing contact with the roller R2. The drive unit D is thereafter actuated to start the feed of paper, which is then stopped and cut for making a copy. In response to a signal indicating the completion of the copying operation, the solenoid 26 is de-energized, and the main motor M is de-energized upon lapse of a specified period of time. The parts are operated in this way under the control of the control unit C. In this case, all the drive systems may be adapted to be turned off in response to the signal indicating the completion of the copying cycle, with the main motor M alone de-energized with a time delay needed for raising the feed roller R1. Alternatively the drive shaft 22 may be driven by a source independent of the main motor.

In the embodiment described above, the solenoid 26 may be de-energized when the rear end of the cut-off sheet of copying paper has passed the transfer roller 14, in which case the feed roller R1 will be raised before the completion of the copying operation.

While a typical embodiment of the invention has been described above, the means for moving the feed rollers R1 and R2 into and out of contact with each other can be suitably modified in connection with the other construction of the copying machine. When the leading end of the copying paper P is unlikely to shift rearwardly under the tension thereon, the paper holding assembly can be dispensed with. The timing with which the feed rollers are contacted and separated may be determined suitably in accordance with the sequential steps of the copying operation.

Obviously, many modifications and variations of the present invention are made possible in the light of the above teachings. It is therefore to be understood that, in the light of the appended claims, the invention may be practiced otherwise than as specifically described.

We claim:

1. In an electrostatic copying apparatus having at least a device for nipping a leading end of a strip of paper as paid off from a roll and for feeding the paper during a copying operation of the apparatus, and a driving motor for operating the apparatus, said device comprising:

a pair of feed rollers for nipping the leading end of the strip of paper and being movable out of contact with one another;

means for holding down the leading end of the strip of paper at least while said pair of feed rollers are moved out of contact with one another, whereby the leading end is maintained in readiness for the copying operations during the inoperation of said driving motor;

means for moving said pair of feed rollers out of contact with one another;

means for actuating said moving means; and means for controlling at least the operation of said feed rollers, said driving motor and said actuating means so as to maintain said rollers in contact with one another during the copying operation of the apparatus, said actuating means being arranged for effecting movement of said rollers out of contact with one another during inoperation of said driving motor.

2. In the apparatus according to claim 1 wherein said moving means comprises at least one lever mounted on the apparatus for pivotal movement between opposite ends thereof, one of said feed rolls being rotatably mounted at one end of said lever, said actuating means being operatively coupled with said lever for pivoting same to effect movement of said feed rollers out of contact with one another.

3. In the apparatus according to claim 2, wherein said actuating means includes a rotatable cam engageable with said lever for pivoting same, and further includes means for rotating said cam.

4. In the apparatus according to claim 3, wherein said cam is freely mounted on a shaft which is mounted in the apparatus for rotation by said driving motor, said actuating means still further including clutch means on said shaft for coupling said cam to said shaft for pivoting said lever at the termination of the operation of said driving motor.

5. In the apparatus according to claim 4, wherein said actuating means still further includes a solenoid connected to a V-shaped engaging arm mounted for pivotal movement on the aparatus, said clutch means including a clutch drum, one end of said arm engaging said drum during energization of said solenoid by said controlling means during the copying operation for uncoupling said cam from said shaft to thereby permit said rollers to nip the leading end of the paper strip, and the other end of said arm engaging said drum during de-energization of said solenoid for coupling said cam to said shaft so as to effect the pivoting of said lever by said cam.

6. In the apparatus according to claims 1, 2, 3, 4 or 5, wherein said lever has a forked end opposite said one end so as to define a cam contact portion and a transfer roll depressing portion, said cam being in alignment with said contact portion for engagement therewith.

7. In the apparatus according to claim 6, wherein the apparatus includes a photoconductive drum and an image transfer roller mounted on the apparatus for engagement with said photoconductive drum during operation of the apparatus and for disengagement therefrom during inoperation of the apparatus.

8. In the apparatus according to claim 7, wherein said depressing portion engages said transfer roller for movement thereof away from said photoconductive drum upon the pivoting movement of said lever.

9. In the apparatus according to claim 1, wherein said holding down means includes a guide plate and a disc roller mounted on the apparatus for pivotal movement into bearing contact with said plate for maintaining the leading end of the paper strip thereagainst when said lever is pivoted to effect movement of said feed rollers out of contact with one another.

10. In the apparatus according to claim 9, wherein said holding down means further includes a pivotally mounted paper holding assembly with said disc roller mounted for free rotation thereon, an actuating lever pivotally mounted on the apparatus and linked together with said one end of said one lever, said actuating lever bearing against said assembly for pivoting said idler roller away from said guide plate when said feed rollers are in contact.

* * * * *